US008998273B2

(12) United States Patent
Debroucke et al.

(10) Patent No.: US 8,998,273 B2
(45) Date of Patent: Apr. 7, 2015

(54) LOCK FOR A VEHICLE OPENING LEAF FITTED WITH AN OPERATING LEVER

(75) Inventors: François Debroucke, Creteil Cedex (FR); Cedric Lamidon, Creteil Cedex (FR)

(73) Assignee: Valeo Securite Habitacle, Créteil (FR)

( * ) Notice: Subject to any disclaimer, the term of this patent is extended or adjusted under 35 U.S.C. 154(b) by 102 days.

(21) Appl. No.: 13/513,902

(22) PCT Filed: Dec. 2, 2010

(86) PCT No.: PCT/EP2010/068708

§ 371 (c)(1), (2), (4) Date: Jun. 20, 2012

(87) PCT Pub. No.: WO2011/069883

PCT Pub. Date: Jun. 16, 2011

(65) Prior Publication Data

US 2012/0248795 A1 Oct. 4, 2012

(30) Foreign Application Priority Data

Dec. 8, 2009 (FR) ..... 09 05950

(51) Int. Cl.
*E05C 3/06* (2006.01)
*E05B 17/00* (2006.01)
*E05B 85/26* (2014.01)

(52) U.S. Cl.
CPC ..... *E05B 17/007* (2013.01); *E05B 85/26* (2013.01); *Y10S 292/23* (2013.01)

(58) Field of Classification Search
USPC ..... 292/200, 216, 201, DIG. 23
See application file for complete search history.

(56) References Cited

U.S. PATENT DOCUMENTS

| | | | | | |
|---|---|---|---|---|---|
| 4,569,544 | A * | 2/1986 | Escaravage | ..... | 292/216 |
| 4,588,217 | A * | 5/1986 | Escaravage | ..... | 292/201 |
| 5,137,311 | A * | 8/1992 | Brackmann | ..... | 292/216 |
| 5,564,761 | A * | 10/1996 | Mizuki et al. | ..... | 292/201 |
| 5,618,068 | A * | 4/1997 | Mitsui et al. | ..... | 292/201 |
| 5,735,557 | A * | 4/1998 | Harvey | ..... | 292/216 |
| 6,135,513 | A * | 10/2000 | Hamada et al. | ..... | 292/201 |
| 7,261,338 | B2 * | 8/2007 | Spurr | ..... | 292/216 |
| 8,528,950 | B2 * | 9/2013 | Organek et al. | ..... | 292/216 |
| 8,876,176 | B2 * | 11/2014 | Spurr et al. | ..... | 292/216 |

FOREIGN PATENT DOCUMENTS

| | | | |
|---|---|---|---|
| DE | 100 43 574 | A1 | 11/2001 |
| FR | 2 906 291 | A1 | 3/2008 |
| GB | 927 222 | A | 5/1963 |

OTHER PUBLICATIONS

International Search Report w/translation from PCT/EP2010/068708 dated Mar. 18, 2011 (4 pages).

* cited by examiner

*Primary Examiner* — Mark Williams
(74) *Attorney, Agent, or Firm* — Osha Liang LLP

(57) ABSTRACT

The opening system according to the invention is arranged so that a distance between a first geometric straight line passing through the region of contact between the lever (10) and the rotary member (12) and normal to this contact region and a second geometric straight line parallel to the first straight line and passing through the axis of rotation of the lever (10) progresses in a constant direction of increase or of decrease throughout the opening movement of the opening leaf.

10 Claims, 2 Drawing Sheets

LOCK FOR A VEHICLE OPENING LEAF FITTED WITH AN OPERATING LEVER

BACKGROUND OF THE INVENTION

The invention concerns vehicle opening leaf locks.

The locks of a vehicle opening leaf usually comprise a large number of parts notably enabling opening of the opening leaf either from the exterior of the vehicle or from the interior. Among the latter, each of the exterior and interior handles is able to drive rotation of the same intermediate lever that comes to bear against a dummy pawl that drives a pawl which itself releases the bolt, which is released from the keeper, thus releasing the opening leaf.

During the opening maneuver, the user, when actuating one of the handles, exerts a force the intensity of which increases very rapidly and then decreases as soon as the pawl has released the bolt which itself has released the keeper. The trend of this force curve is that of a spike and the sensation experienced is similar to an impact. This rising intensity trend is explained by the fact that the user must cause the parts to travel a certain number of dead strokes and then to overcome the forces provided by return springs of the mechanism and finally to provide the highest force to release the pawl that has released the bolt from the keeper. However, this sensation of impact, even if it is the norm, is relatively disagreeable.

BRIEF SUMMARY OF THE INVENTION

An object of the invention is to improve the comfort of the user on opening the opening leaf.

To this end, there is provided in accordance with the invention a vehicle opening leaf system characterized in that it comprises:

a lever rotatably mounted about an axis;

a rotary member adapted to be maneuvered by the lever, the system being such that a distance between a first geometrical straight line segment passing through the area of contact between the lever and the rotary member and normal to that area of contact and a second geometrical straight line segment parallel to the first straight line segment and passing through the rotation axis of the lever constantly increases or decreases throughout the movement of opening the opening leaf.

Assuming that the rotary member is moved about its axis with a moment of constant intensity, knowing that the force that it receives is exerted at an application point remaining at a constant distance from that axis, this force is of constant intensity. Under these conditions, the increase in the distance separating the area of contact in which this force is exerted and the rotation axis of the lever leads to the moment that causes the lever to turn having an increasing intensity during opening. The force exerted by the user on the handle has an intensity that corresponds to this moment. In other words, the user feels this moment on the handle. The user must therefore exert a force of increasing intensity to continue to actuate the rotary member by means of the lever. This increase in force occurs before the bolt begins to be moved relative to the keeper and the user must increase the force sooner than in the aforementioned prior art. This leads to a greater spreading over time over this increase in intensity. Although the final force to be exerted is thus substantially the same, the increase to reach it begins sooner and so the user does not experience a spike or an impact when maneuvering the handle, but to the contrary an earlier and more regular increase in intensity. This makes the maneuver more comfortable.

The lever and the member are preferably conformed so that, on opening, they are in mutual contact via profiled faces having parallel generatrices.

Thus a reduced area of contact is produced between the two elements, which reduces the impact when they come into mutual contact and reduces the friction during their relative movements.

The member preferably comprises a support and a roller rotatably mounted relative to the support and adapted to roll against the lever.

Accordingly, the contact between the two elements generates only rolling friction, which reduces the force to be exerted by the user to open the opening leaf.

The system of the invention may further have at least any one of the following features:

- the lever has a ramp face along which the area of contact moves during opening;
- the ramp face has a curved profile;
- the ramp face has a profile a radius of curvature of which decreases over a section traveled by the member during opening;
- the ramp face has a profile of elliptical and/or concave shape;
- the member comprises a dummy pawl; and
- at least one of the driving parts comprises a rotatably mounted lever.

BRIEF DESCRIPTION OF THE DRAWINGS

Other features and advantages of the invention will become more apparent in the following description of one embodiment given by way of nonlimiting example with reference to the appended drawings, in which.

DETAILED DESCRIPTION OF THE INVENTION

Figure 1:
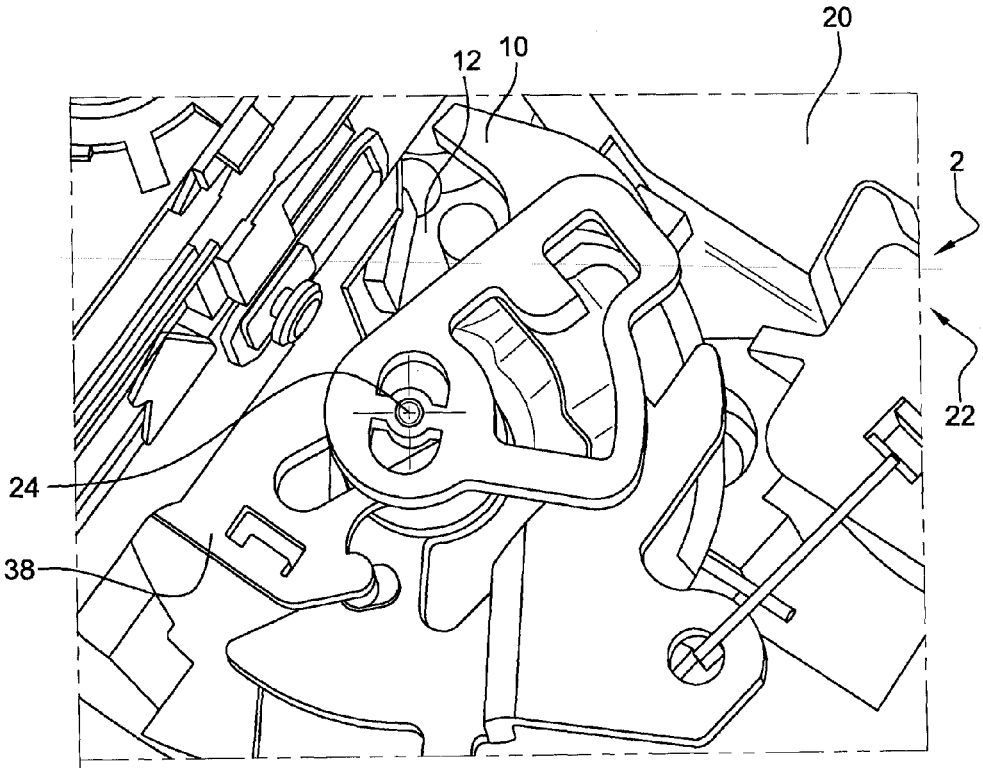
FIG. 1 is a perspective view of part of a lock of one embodiment of the invention.

A system for an opening leaf 22 of an automobile vehicle of one embodiment of the invention will be described with reference to FIGS. 1 and 2. The opening leaf is for example a door. Some parts of the lock referred to hereinafter are of a standard type and are not described in detail and/or shown. For more details of some aspects of the lock see for example the document EP-1 158 124 in the name of the applicant.

The system comprises the following members that are adapted to maneuver each other successively in the order in which they are listed below to transmit an opening leaf opening command, thus forming a kinematic chain;

- an interior opening handle 4,
- an interior cable 6,
- an interior opening lever 8,
- an intermediate opening lever 10,
- a dummy pawl 12,
- a pawl 14,
- a bolt 16, and a keeper 18.

The handle 4 is rotatably mounted relative to a frame 20 of the opening leaf 22. Via the cable 6, it actuates the interior opening lever 8 which is rotatably mounted. The latter actuates the intermediate opening lever 10 which is also rotatably mounted relative to the frame 20 about an axis 24; the dummy pawl 12 and the pawl 14 are rotatably mounted relative to the frame 20 about the same axis 26, but are mobile relative to each other. The axes 24 and 26 are spaced from and parallel to each other.

The system also comprises the following members that are adapted to maneuver each other successively in the order in which they are listed below to transmit an opening leaf opening command, thus forming a kinematic chain:

an exterior handle 30, an exterior cable 32, an exterior opening lever 34, and a clutch lever 36.

Thus the exterior handle 30 is fixed to one end of the cable 32 the other end of which is fixed to the exterior opening lever 34. The latter is mounted to be mobile in rotation and is able to maneuver the clutch lever 36. A clutch 38 is disposed in the kinematic chain between the clutch lever 36 and the intermediate opening lever 10. The clutch 38 may assume an engaged configuration in which it allows maneuvering of the intermediate lever 10 by means of the clutch lever 36 or a disengaged configuration in which the clutch lever is unable to maneuver the intermediate lever.

The kinematic chain portions going from the elements 4 to 8 on the one hand and 30 to 36 on the other hand are distinct and independent of each other. Each allows, independently of the other, maneuvering of the intermediate opening lever 10 to release the pawl 14 from the keeper 16 and thus to release the keeper 18 and thus to open the opening leaf. When it is a question of a maneuver using the handle 30, this assumes that the clutch 38 is engaged.

Figure 3:
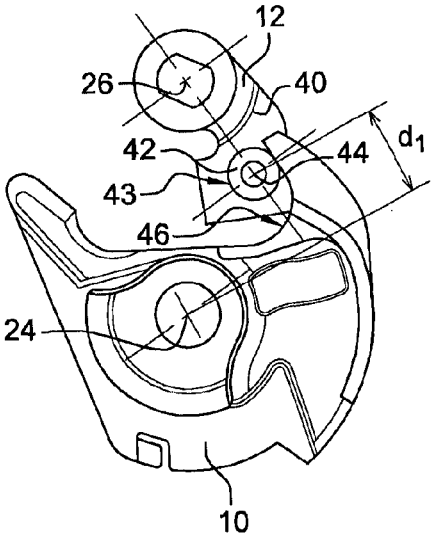
FIGS. 3 and 4 are two plan views of the intermediate lever and the dummy pawl of the lock from FIG. 1, respectively at the beginning of the opening maneuver and then at the end of the latter.

Some aspects of the intermediate lever 10 and the dummy pawl 12 will now be described, notably with reference to FIGS. 1, 3 and 4.

The force pawl 12 comprises a main support 40 and a roller 42 having an external face 43 of cylindrical shape of circular section in a plane perpendicular to the axis 24. The roller is mounted to be mobile in rotation on the support 40 about an axis 44 spaced from the axes 24 and 26 and parallel thereto.

The intermediate lever 10 has a profiled lateral face 46 forming a rolling ramp for the roller 42. This face has a cylindrical general shape but the section of its profile is not circular. Here, this cylindrical face has generatrices parallel to the axis 44 and to the generatrices of the face 43 of the roller 42. Here the face 46 has a profile of curved shape, concave and forming a portion of an ellipse. Over the section of this face over which the roller travels, as will emerge hereinafter, the face 46 has a radius of curvature that decreases in the direction of movement of the roller during opening.

The lock functions in the following manner where the dummy pawl and the intermediate lever are concerned.

Figure 5:
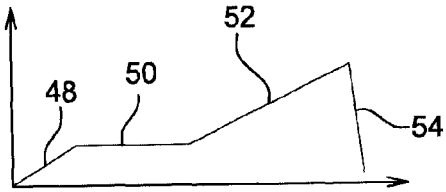
FIG. 5 is a general curve of the evolution of the force exerted by the user as a function of the stroke of the handle during the opening maneuver.

There is shown in FIG. 5 the general curve of the intensity of the force exerted by the user on one of the handles 4, 30 to open the opening leaf as a function of the stroke of the handle.

In the first part illustrated by the section 48 of the curve, the user begins to maneuver the handle and moves it over the path necessary to bring the parts situated upstream of the intermediate lever 10 into contact after travelling their dead strokes and to overcome the return spring or springs of the mechanism and notably that of the handle. The force increases over this section. The lever 10 has not yet been moved.

Once the force produced by the springs has been compensated, the second section 50 of the curve is begun during which all the parts situated upstream of the intermediate lever 10 and that the movement in question concerns as well as the latter lever are moved. The lever 10 is moved until it comes into contact with the roller 42. This section corresponds to a substantially constant force for the user.

The next section 52 corresponds to the phase of the movement during which the intermediate lever 10 maneuvers the dummy pawl 12. Knowing that the roller rolls against the lever 10, the force exerted by the latter on the dummy pawl is essentially reduced to its component perpendicular to the tangent to the contact faces. At the beginning of this movement, as shown in FIG. 3, the area of contact between the roller 42 and the face 46 is located at a distance d1 of approximately 10 mm from the axis 24, when this distance is measured tangentially to the face 46 at the place of contact with the roller.

Such a distance d1 is measured between a first geometric straight line segment passing through the area of contact and normal thereto and a second geometrical straight line segment parallel to the first straight line segment and this time passing through the rotation axis of the lever. As will emerge hereinafter this distance increases as the opening leaf opens.

The distance d1 measured in this way is the lateral distance from the axis of the feedback force between roller and lever relative to the axis 24 of the lever.

Figure 4:
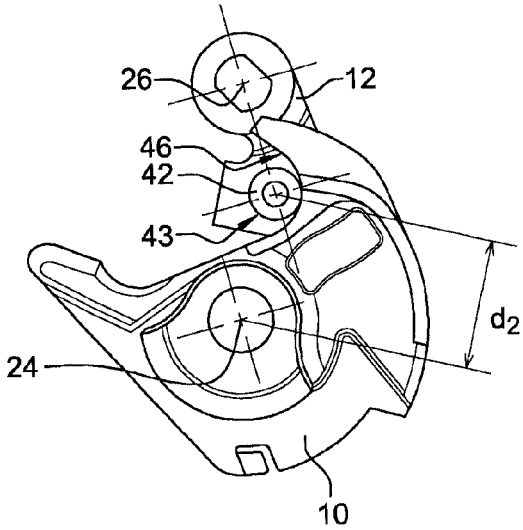

The roller 42 rolls against the ramp face 46 as far as the position shown in FIG. 4. In this latter position, the area of contact between the roller and the lever 10 is at a distance d2 from the axis 24 that is greater than the distance d1, measured in the same manner as previously, of approximately 14 mm, for example.

Knowing that the roller rolls against the lever 10, the force exerted by the latter on the dummy pawl is essentially reduced to its component perpendicular to the tangent to the contact faces. As shown in FIG. 4, the area of contact between the roller 42 and the face 46 is located at a distance d2 of approximately 14 mm from the axis 24 when this distance d2 is measured tangentially to the face 46 at the place of contact with the roller.

This distance d2, measured between a first geometrical straight line segment passing through the contact area and normal to that contact area and a second geometrical straight line segment parallel to the first straight line segment and this time passing through the rotation axis 24 of the lever, also increases over the whole of the opening movement of the opening leaf.

Thus the user experiences an increasing resistance on the handle throughout the movement of manual actuation of the handle, whence an enhanced sensation for them.

Such an improved "feel" results notably from the absence of upward and then downward variations, which tends to give the user a sensation of inappropriate mechanical succession during the movement.

In another embodiment, the ramp face 46 is conformed so that the lever arm decreases over the whole of the opening movement of the ramp. Thus the user then experiences a resistance to the movement without successive variations in the upward and then downward direction.

Such a decreasing resistance is notably obtained with a ramp 46 of convex shape, with a curvature adapted to a decrease in the lever arm measured in the same manner as explained above.

The distance d2 measured in this way is again the lateral distance from the axis of the feedback force between roller and lever relative to the axis 24 of the lever.

Figure 2:
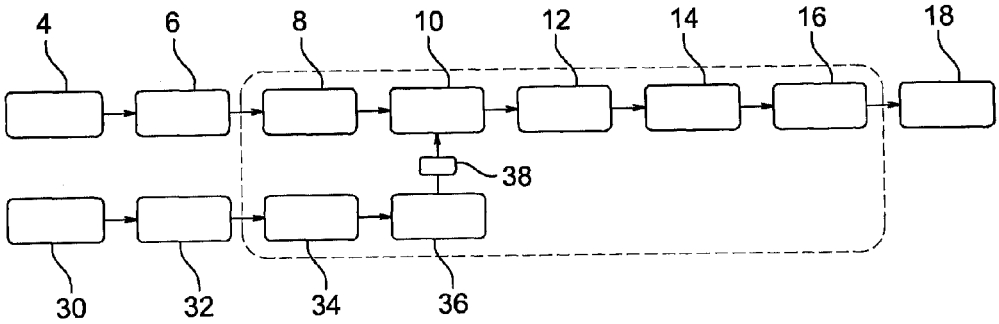
FIG. 2 is a diagram of the kinematic chain of the parts of the lock from FIG. 1.

Assuming constant the intensity of the force to be exerted by the intermediate lever 10 to cause the dummy pawl 12 to turn about its axis 26, the moment to be exerted on the lever to produce this force, by traction on the cable 8 or 34, is greater in the FIG. 4 position than in the FIG. 1 position. Over the section 52, the user must thus actuate the handle with a force of increasing intensity, given an improved feel. It is seen that the movement of the lever 10 in the section 52 tends here to load the roller 42 to cause it to pass between the axes 24 and 26.

Once arrived at the FIG. 4 position, the bolt is released from the keeper, which leads to a drop in the intensity of the force in the last section 54.

Figure 6:
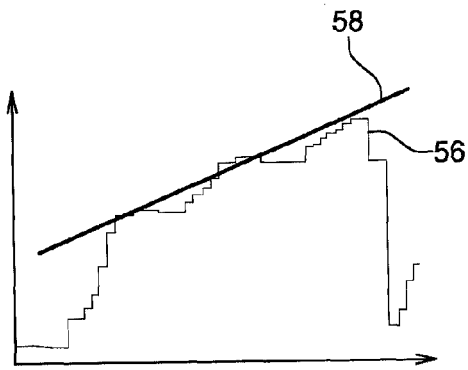
FIG. 6 is a view analogous to FIG. 5 showing this evolution during the maneuvering of the dummy pawl by the lever.

FIG. 6 shows in greater detail a curve 56 obtained from experimental measurements corresponding to the section 52 and a straight line segment 58 indicating the general trend. This straight line segment is only slightly inclined to the horizontal, thus signifying that the increase in the force is relatively slow during this phase.

The straight line segment 58 corresponds to a substantially linear increase in the distance d, previously shown with the references d1 and d2, during lock opening actuation. Such a linear progression 58 is obtained thanks to the profile of the face 46 of the present embodiment.

Other profiles may be adopted, by trial and error or by geometrical calculation, to obtain other plots of the progression of the distance d to procure the required feel for the end user.

The same type of operation naturally takes place whether the maneuver is commanded by means of the interior handle or the exterior handle, assuming that the clutch allows maneuvering of the intermediate lever.

Thus it is seen that it is for the most part the shape of the profile of the face 46 of the intermediate lever that determines the trend of the evolution of the intensity of the opening force exerted by the user. This shape may thus be adapted as a function of the required evolution. The invention offers for this a solution that is simple, of relatively low cost and easy to implement.

Of course, numerous modifications may be made to the invention without departing from its scope.

There is described hereinabove an embodiment in which the ramp 46 is produced inside a lock. The invention nevertheless provides for such a ramp to be placed on a component of another part of the system for opening the opening leaf, such as within an interior or exterior handle for opening the opening leaf, for example.

The invention claimed is:

1. A system for a vehicle opening leaf, comprising:

a lever rotatably mounted about a first axis, the lever being configured to be rotationally actuated in response to operation of a vehicle door handle; and a rotary member configured to be maneuvered in rotation about a second axis by the lever, the rotary member comprising a roller rotatably mounted about a third axis spaced from the first and the second axes, wherein the lever and the roller are conformed to be in contact with an area of contact during the movement of opening the vehicle opening leaf; and wherein the lever and the roller are conformed so that a distance between a first geometrical straight line segment passing through the area of contact and normal to the area of contact, and a second geometrical straight line segment parallel to the first straight line segment and passing through the rotation axis of the lever, constantly increases or decreases throughout a movement of opening the vehicle opening leaf.

2. The system claimed in claim 1, wherein the lever and the rotary member are conformed so that, throughout the movement of opening the vehicle opening leaf, the lever and the rotary member are in mutual contact via profiled faces having generatrices parallel to each other.

3. The system claimed in claim 1, wherein the rotary member comprises a support, and wherein the roller is rotatably mounted relative to the support and adapted to roll against the lever.

4. The system claimed in claim 1, wherein the lever has a ramp face along which the area of contact moves during the movement of opening the vehicle opening leaf, the ramp face having a profile such that the distance between the first geometrical straight line segment passing through the contact area and normal thereto and the second geometrical straight line segment parallel to the first straight line segment and passing though the rotation axis of the lever constantly increases or decreases throughout the movement of opening the vehicle opening leaf.

5. The system claimed in claim 4, wherein the ramp face has a profile, a radius of curvature of which decreases over a section travelled by the rotary member during the movement of opening the vehicle opening leaf.

6. The system claimed in claim 4, wherein the ramp face has a profile of elliptical shape.

7. The system claimed in claim 4, wherein the ramp face has a profile of concave shape.

8. The system claimed in claim 4, wherein the ramp face has a profile chosen so that the distance between the first geometrical straight line segment passing through the contact area and normal thereto and the second geometrical straight line segment parallel to the first straight line segment and passing though the rotation axis of the lever changes in a substantially linear manner throughout the opening movement of the vehicle opening leaf.

9. The system claimed in claim 1, further comprising a lock, wherein the lever is disposed in the lock.

10. The system claimed in claim 1, further comprising a handle for opening the vehicle opening leaf, wherein the lever is disposed in the handle for opening the vehicle opening leaf.

* * * * *